US006803165B2

(12) United States Patent
Ishimaru et al.

(10) Patent No.: US 6,803,165 B2
(45) Date of Patent: Oct. 12, 2004

(54) TONER FOR ELECTROPHOTOGRAPHY, DEVELOPING AGENT FOR ELECTROPHOTOGRAPHY USING THE TONER, IMAGE FORMING METHOD, AND IMAGE FORMING DEVICE

(75) Inventors: Seijiro Ishimaru, Kawasaki (JP); Yasushige Nakamura, Kawasaki (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 10/103,569

(22) Filed: Mar. 22, 2002

(65) Prior Publication Data

US 2003/0124447 A1 Jul. 3, 2003

(30) Foreign Application Priority Data

Dec. 14, 2001 (JP) ..... 2001-380998

(51) Int. Cl.[7] ..... G03G 9/097

(52) U.S. Cl. ..... 430/108.4; 430/109.4; 430/124; 399/336

(58) Field of Search ..... 430/108.1, 108.4, 430/109.4, 124; 399/336

(56) References Cited

U.S. PATENT DOCUMENTS 5,714,292 A * 2/1998 Anno et al. ..... 430/108.4
6,415,122 B1 * 7/2002 Hara et al. ..... 399/128
2003/0017407 A1 * 1/2003 Nakamura et al. ..... 430/108.1

FOREIGN PATENT DOCUMENTS

JP 2001-83739 3/2001

* cited by examiner

*Primary Examiner*—Janis L. Dote
(74) *Attorney, Agent, or Firm*—Westerman, Hattori, Daniels & Adrian, LLP

(57) ABSTRACT

A toner for electrophotography contains at least one kind of cyclic compound selected from cyclic oligomers and cyclic polymers substantially having no terminal group, and the image forming device includes at least an electrostatic latent image carrier, an electrostatic latent image forming means for forming electrostatic latent images on the electrostatic latent image carrier, a developing means for forming visible images by developing the electrostatic latent images containing a developing agent for electrophotography, and a transfer means for transferring the visible images to a transfer material. Thus, the present invention provides a toner for electrophotography capable of providing well-balanced electrostatic property and fixing property during the image forming process in order to form images of high quality in a stable manner, and an image forming device.

17 Claims, No Drawings

TONER FOR ELECTROPHOTOGRAPHY, DEVELOPING AGENT FOR ELECTROPHOTOGRAPHY USING THE TONER, IMAGE FORMING METHOD, AND IMAGE FORMING DEVICE

BACKGROUND OF THE INVENTION

1. Field of the Invention

The invention relates to a toner for electrophotography, which may be suitably be used for developing electrostatic latent images formed on the surface of an electronic latent image carrier (photoconductive insulator) such as a photoconductor drum, as well as a developing agent for electrophotography containing the toner for electrophotography, an image forming method, and an image forming device using the developing agent for electrophotography.

2. Description of the Related Art

Electrophotography is well known as a conventional method for visualizing electric image data on recording media such as recording paper. In electrophotography, first forming an electrostatic latent image by exposing in the shape of an image using an exposing device, etc., after evenly electrically charging the surface of an electronic latent image carrier (photoconductive insulator) such as a photosensitive drum using a charging device, e.g., a corona discharger; next, forming a visible image (toner image) by developing the electrostatic latent image by means of causing either a one-component electrophotography developing agent or a two-component electrophotography developing agent containing an electrically charged toner to adhere to the electrostatic latent image; then transferring the visible image (toner image) to recording media such as recording paper etc.; and finally fixing the visible image (toner image) by melting, solidifying and fixing by means of a process such as pressing, heating, press-heating, and light beam irradiating, thereby a desired image is formed on the recording media.

It is preferable that the toner has high performance capabilities because the quality of images formed by the electrophotography is highly dependent on its performance capabilities such as electrostatic property for causing it to adhere to the electrostatic image, and fixing property for causing it to be melted so as to be fixed on the recording media.

The toner is made up of a charging control agent, a coloring agent, etc., contained in a binder resin, and as the binder resin, a polyester resin, a styrene-acrylic resin, an epoxy resin, etc., are commonly used. As these substances consist of monomers having polar groups such as the COOH group or the OH group at the ends, showing relatively negative polarity and hygroscopic characteristics in response to humidity, wherein a toner using one of these as a binder resin, especially, a toner using polyester resin as a binder resin, tends to cause insufficient charging, while if it is made a positive polarity toner, reverse charging or insufficient charging tend to occur. Thus, these toners are not sufficient from the standpoint of the electrostatic property. Any attempt to replace the COOH group or the OH group in those binder resins so as to remove polarities introduces another problem in that it makes them too difficult and too expensive to manufacture. Moreover, although the electrostatic property can be improved to some degree by polymerizing the binder resins, polymerization in turn causes deterioration in the fixing property.

Electrostatic property and the fixing property are in an antinomic relation to each other, so that no toner for electrophotography providing these charging and fixing property superior balance, nor are any developing agent for electrophotography using such a toner, image forming method, and image forming devices using such a toner available on the market today, thus allowing development of demand.

The intention of the present invention is to solve such problems of the prior art and to achieve the following object. The object of the present invention is to provide a toner for electrophotography capable of providing well-balanced electrostatic property and fixing property during the image forming process hence forming images of high quality in a stable manner, as well as a developing agent for electrophonic photography, an image forming method, and an image forming device using the toner for electrophotography.

SUMMARY OF THE INVENTION

The toner for electrophotography of the present invention contains at least one kind of cyclic compound selected from cyclic oligomers and cyclic polymers that do not essentially have any terminal group. Using such a toner for electrophotography makes it possible to improve the fixing property without sacrificing the electrostatic property, hence enabling it to form images of high quality by maintaining the electrostatic property and the fixing property possessing superior balance during the image forming process.

The developing agent of the present invention contains at least the toner for electrophotography of the present invention. Using such a developing agent for electrophotography makes it possible to improve the fixing property without sacrificing the electrostatic property, hence enabling it to form images of high quality by maintaining the electrostatic property and the fixing property possessing superior balance during the image forming process.

The image forming method of the present invention includes at least an electrostatic latent image forming process for forming electrostatic latent images on an electrostatic latent image carrier, a developing process for developing the electrostatic latent images and forming visible images using the developing agent for electrophotography of the present invention, and a transfer process for transferring the visible images to a transfer material. In the image forming method, electrostatic latent images are formed on the electrostatic image carrier during the electrostatic latent image forming process. Developing the electrostatic latent images using the developing agent for electrophotography of the present invention during the development process forms visible images. The visible images are transferred to the transfer material during the transfer process.

The image forming device of the present invention includes at least an electrostatic latent image carrier, an electrostatic latent image forming means for forming electrostatic latent images on the electrostatic latent image carrier, a developing means containing a developing agent for electrophotography of the present invention for developing the electrostatic latent images and forming visible images, and a transfer means for transferring the visible images to a transfer material. In the image forming device, the electrostatic latent image forming means forms electrostatic latent images on the electrostatic latent image carrier. The developing means contains the developing agent for electrophotography and develops the electrostatic latent images to form visible images. The transfer means transfers the visible images to the transfer material. As a result, images are formed on the transfer material.

DESCRIPTION OF THE PREFERRED EMBODIMENT (Toner for Electrophotography)

The toner for electrophotography of the present invention contains at least a cyclic compound, as well as a binder resin, a coloring agent, charging controlling agent, etc., and other contents as needed.

Cyclic Compound

The cyclic compound is not particularly limited other than that it must be at least one kind of cyclic compound selected from cyclic oligomers and cyclic polymers that do not essentially have any terminal group.

In the above, "do not essentially have any terminal group" means they "do not have any terminal group at the ends of a molecule," so that, although it is desirable that molecule does not have any polarity group, the invention allows the molecule to have a group with small polar amounts on its side chains.

The cyclic compound is not limited as long as it is at least one kind of cyclic compound selected from cyclic oligomers and cyclic polymers that do not essentially have any terminal group, for example, preferably ester compounds.

These compounds can be used alone or as a mixture of more than two kinds. Of these, an ester compound is more preferable as it is easier to manufacture and can also provide balanced electrostatic property and fixing property in a toner for electrophotography.

The ester compound is not particularly limited and it can be selected suitably in accordance with a specific purpose and obtained by condensing/polymerizing dicarboxylic compounds, diol compounds, hydroxycarboxylic compounds, etc., using a publicly known method, preferably compounds obtained by condensation/polymerization of dicarboxylic compounds and diol compounds or compounds obtained by condensation/polymerization of dicarboxylic compounds, diol compounds, and hydroxycarboxylic compounds. Specific examples of compounds obtained by condensation/polymerization of dicarboxylic compounds and diol compounds are preferably a compound obtained by condensation/polymerization of terephthalic acid and bisphenol A as expressed by the following formula (1), or a compound obtained by condensation/polymerization of terephthalic acid and bisphenol A propylene oxide as expressed by the following formula (2).

Structural formula (1)

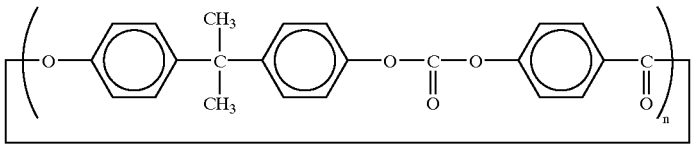

Structural formula (2)

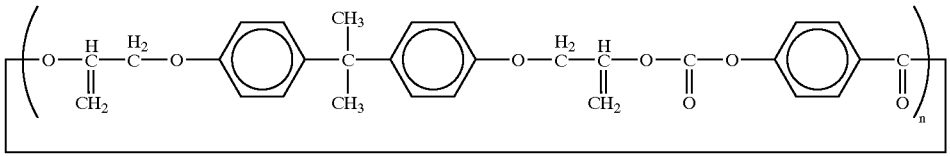

In the structural formula (1) and (2) above, n is the degree of polymerization and an integer of more than 1.

Of the abovementioned compounds obtained by condensation/polymerization, those preferable are obtained by condensation/polymerization of the same number of dicarboxylic compounds and diol compounds.

If a compound is obtained by condensation/polymerization of the same number of dicarboxylic compounds and diol compounds, the number of units originating from the dicarboxylic compound in the condensation/polymerization compound is equal to the number of units originating from the diol compound. In this case, the ratio between the number of units originating from the dicarboxylic compound and the number of units originating from the diol compound is, for example, 1:1, 2:2, 3:3, etc. In this case, there is no polar group at the ends in the condensation/polymerization compound, and the acid value and the hydroxyl value of the condensation/polymerization compound are both zero, so that the electrostatic property and the fixing property can be well balanced, providing a desirable overall characteristic.

The dicarboxylic compounds can be selected from divalent carboxylic acid monomers that are publicly known; e.g., preferably, maleic acid, fumaric acid, citraconic acid, itaconic acid, glutaconic acid, succinic acid, adipinic acid, sebacic acid, azelaic acid, malonic acid, n-dodecenyl succinic acid, isododecenyl succinic acid, n-dodecyl succinic acid, isododecyl succinic acid, n-octenyl succinic acid, n-octyl succinic acid, phthalic acid, isophthalic acid, terephthalic acid, and anhydrides of these acids, aliphatics such as lower alkyl ester or aromatic dicarboxylic acids, etc.

These compounds can be used alone or as a combination of two or more compounds. Of these, terephthalic acid is preferable from the standpoint of reaction stability of carboxylic acid.

Candidates for the diol compounds can be selected from divalent alcohol monomers that are publicly known; e.g., etherized bisphenol, ethylene glycol, diethylene glycol, triethylene glycol, 1,2-propylene glycol, 1,3-propylene glycol, 1,4-butanediol, neopentyl glycol, 1,4-butanediol, 1,5-pentane diol, 1,6-hexane diol, 1,4-cyclohexane dimethanol, dipropylene glycol, polyethlene glycol, polypropylene glycol, polytetramethylene glycol, bisphenol A, hydrogenated bisphenol A, etc.

Of these, etherized bisphenol is preferable from the standpoint of electrostatic property and fixing property, wherein specific examples of the etherized bisphenol are polyoxypropylene (2.2)-2,2-bis (4-hydroxyphenyl) propane; polyoxypropylene (3.3)-2,2-bis (4-hydroxyphenyl) propane; polyoxyethylene (2.0)-2,2-bis (4-hydroxyphenyl) propane; polyoxypropelene (2.0)-polyoxyethylene (2.0)-2,2-bis (4-hydroxyphenyl) propane; polyoxypropelene (6)-2,2-bis (4-hydroxyphenyl) propane, etc.

These compounds can be used alone or as a combination of two or more compounds.

The hydroxycarboxylic compounds can be selected from, for example, hydroxycarboxylic acid, hydroxybenzoic acid, salicylic acid, tartaric acid, citric acid, tropic acid, benzilic acid, gluconic acid, glucono-δ-lactone, glycolic acid, glyceric acid, galacturonic acid, galactonic acid, galactono-γ-lactone, lactic acid, hydroxyisobutyric acid, hydroxypivalic acid, hydroxyoctanoic acid, etc.

These compounds can be used alone or as a combination of two or more compounds.

The molecular weights of the cyclic compounds are preferably 10,000 or less, more preferably less than 2,000, and especially preferably 400–2,000.

It is advantageous in terms of providing a toner for electrophotography of an excellent fixing property if the molecular weight is 10,000 or less, as the material can be readily adhered to transfer materials (recording media) such as recording paper at low energy levels, and if it is 2,000 or less, it is advantageous in terms of providing a toner for electrophotography of a remarkably excellent fixing property.

The molecular weights of the cyclic compounds can be measured by publicly known methods. For example, if the molecular weights of the cyclic compounds are approximately 500 or less, they can be suitably measured by GC-MS, FDMS, etc.; if the molecular weights of the cyclic compounds are more than 500 and 3,000 or less, they can be suitably measured by FDMS, and gel permeation chromatography etc., and if the molecular weights of the cyclic compounds are more than 3,000 and equal to 10,000 or less, they can be suitably measured by gel permeation chromatography.

The content of the cyclic compound in the toner for electrophotography is preferably less than 30% by mass, more preferably 0.01–20% by mass, and further more preferably 1–15% by mass.

When the content exceeds 30% by mass, the resin strength reduces, thus lowering the fixing property and the fretting property, and may end up causing such problems as over-pulverization due to churning inside the developing device, blurred images on the transfer material (recording media), back copying on the transfer material, etc., while if it is less than 0.01% by mass, it becomes difficult to maintain a superior balance of the fixing property and the electrostatic property. On the other hand, if the content is less than 30% by mass, there are no such problems. If it is 0.01–20% by mass, an excellent fixing property is obtained and enables to maintain a superior balance with electrostatic property at high dimension results, while if it is 1–15% by mass, a remarkably better effect results.

Binder Resin

There is no particular restriction for the binder resin and it can be selected suitably in accordance with a specific purpose, for example, preferably from thermoplastic resins such as natural polymers and synthetic high polymers; more specifically, epoxy resin, styrene-acrylic resin, polyacryl resin, polyamide resin, polyester resin, polyvinyl resin, polyurethane resin, and polybutadiene resin, etc. Of these, polyester resin is preferable from the standpoint of fixing property and resin strength.

The binder resin is not particularly limited and can be selected suitably in accordance with a specific purpose, for example, preferably from those with weight average molecular weight of 4,000–100,000, and preferably from those with melting point of approximately 90–150° C.

The content of the binder resin in the toner for electrophotography is not particularly limited, but 50 mass weight % or higher is preferable from the standpoint of electrostatic property, and 50–95 mass weight % is more preferable.

Coloring Agent

The coloring agent is not particularly limited and it can be selected suitably from publicly known dyes or pigments according to colors used for the toner for electrophotography, i.e., black, red, yellow, blue, green, etc.

The coloring agent in case of black can be selected from, e.g., various carbon blacks obtained by the thermal black method, the acetylene black method, the channel black method, and the lamp black method, etc., graft carbon black obtained by coating carbon blacks with resin, inorganic pigments such as iron black, chromatic dyes and organic pigments, nigrosine dyes, and azoic dyes, etc.

The coloring agent in case of red can be selected from, e.g., anthraquinone, quinacridon, bisazoic dyes, monoazoic dyes, etc.

The coloring agent in case of yellow can be selected from, e.g., anilides compound, benzidine, benzimidazolone, bisazoic dyes, etc.

The coloring agent in case of blue can be selected from, e.g., phthalocyanine, etc.

The coloring agent in case of green can be selected from, e.g., halogenated phthalocyanine, etc.

These coloring agents can be used alone or as a combination of two or more compounds.

The content of the coloring agent in the toner for electrophotography should preferably be 0.1–10% by mass, or more preferably 2–5% by mass.

If the content is less than 0.1% by mass, the degree of pigmentation of images fixed on transfer materials (recording media) may deteriorate; on the other hand, if it exceeds 10% by mass, various characteristics of the toner such as electrostatic property may deteriorate resulting in a high raw material cost.

Charging Control Agent

The charging control agent can distribute the charging amount of the toner for electrophotography in the binder resin for the purpose of controlling it within the desired range.

The charging control agent should preferably be selected to be either a positive or negative charging control agent depending on whether it is desired to charge the binder resin positive or negative.

The positive charging control agent can be selected from nigrosine dyes, quaternary ammonium salt, triphenylmethane derivative, etc.

The negative charging control agent can be selected from metallized azoic complex, naphtolate zinc comlex, zinc salicylate complex, calix arene compounds, etc.

These charging control agents can be used alone or as a combination of two or more compounds.

The content of the charging control agent in the toner for electrophotography should preferably be 5% by mass or less, or more preferably 3% by mass or less.

Other Components

The other components of the above agents is not particularly limites and can be selected suitably as needed for specific purposes, for example, from infrared absorbing agents, fixing assistants, plasticizers, etc.

The infrared absorbing agents can be preferably used when the toner for electrophotography is used as a toner for flash fixing.

The infrared absorbing agent is not particularly limited and can be selected suitably from publicly known infrared absorbing agents, for example, aluminum compounds, di-immonium compounds, cyanine compounds, polymethine compounds, nickel complex compounds, phthalocyanine compounds, tin oxide, lanthanoid compounds, etc.

The fixing assistants can be selected from, for example, waxes, metallic soaps, surfactants, etc.

The waxes can be selected from, for example, polypropylene wax, polyethylene wax, carnauba wax, ester wax, etc.

The metallic soaps can be selected from, for example, zinc stearate, etc.

The surfactants can be selected from, for example, nonionic surfactant, etc.

The fluidizing agent is not particularly limited and can be selected suitably for a specific purpose from, for example, inorganic fine particles, etc.

The fine particles should preferably be used by being externally added to the toner for electrophotography.

The diameters of the inorganic fine particles should be, preferably in terms of the primary particle diameter (numerical average particle diameter ($D_{50}$)), 5 nm–2 $\mu$m, or more preferably 5 nm–500 nm.

The specific surface area of the inorganic fine particles based on the BET method should preferably be 20–500 $m^2/g$.

The inorganic fine particles can be selected from, for example, silica particulate, alumina, titanium oxide, barium titanate, magnesium titanate, calcium titanate, strontium titanate, zinc oxide, silica sand, clay, mica, wollastonite, diatomite, chromium oxide, cerium oxide, red oxide, antimony trioxide, magnesium oxide, zirconium oxide, barium sulfate, barium carbonate, calcium carbonate, silicon carbide, and silicon nitride. Of these, silica fine particles are particularly preferable.

These fine particles can be used alone or as a combination of two or more kinds of fine particles.

The amount of the inorganic fine particles externally added to the toner for electrophotography should preferably be 0.01–5 parts by mass, or more preferably 0.01–2.0 parts by mass relative to 100 parts by mass of the toner for electrophotography (excluding the externally added inorganic fine particles).

The manufacturing method of the toner for electrophotography is not particularly limited and can be suitably selected in accordance with a specific purpose from, for example, the mechanical pulverization method, in which the cyclic compounds, the binder resins, the coloring agents, the charging control agents, and the other components are mixed using a mixing device such as a Henschel mixer, melted and kneaded using a kneading device, pulverized using a pulverizing device such as a jet mill, and classified into desired particle diameters, or by the spray dry method, in which the components are mixed and suspended in a solvent and sprayed to produce fine particles by means of spray drying, etc., the microcapsule method, the polymerization method, or the hetero-coagulation method, wherein the components are made into fine particles by hetero-coagulating in a water solution containing a surfactant.

Since the toner for electrophotography of the present invention contains the cyclic compound having substantially no terminal group as mentioned above, it is possible to maintain a superior balance between the electrostatic property and the fixing property during image forming when the toner for electrophotography is used, thus making it possible to form images of high qualities in a stable manner.

The toner for electrophotography of the present invention can be a black toner, a magenta toner, an yellow toner, a cyan toner, etc., and can be suitably applied to developing agents for electrophotography, image forming methods based on electrophotography, image forming methods, and image forming devices.

(Developing Agent for Electrophotography)

The developing agent for electrophotography of the present invention contains at least the toner for electrophotography of the present invention and also contains other components suitably selected.

The developing agent for electrophotography of the present invention can be a one component developing agent containing the toner for electrophotography, or a two component developing agent containing the toner for electrophotography and a carrier, but from the standpoint of longevity the two component developing agent is preferable for application to high speed printers capable of faster information processing speeds of recent years.

Carrier

Although there is no particular restriction for the carrier and it can be suitably selected in accordance with a specific purpose, it is preferable to use one having a core material and a resin layer coating the core material.

The material for the core material can be selected from manganese-strontium (Mn—Sr) materials of 50–90 emu/g, manganese-magnesium (Mn—Mg) materials, etc., are preferable; from the standpoint of securing image density, however, high magnetizing materials such as iron powder (100 emu/g or higher) and magnetite (75–120 emu/g) are preferable, while weak magnetizing materials such as copper-zinc (Cu—Zn) (30–80 emu/g) are preferable from the standpoint for aiming higher grade images by means of softening the contacts of the toner to the photoconductor where the toner is standing. These materials can be used alone or as a mixture of more than two kinds of materials.

The particle diameters of the core materials should be, in terms of the average particle diameter (volumetric average particle diameter ($D_{50}$)), 10–150 $\mu$m, or more preferably 40–100 $\mu$m.

If the average particle diameter (volumetric average particle diameter ($D_{50}$)) is less than 10 $\mu$m, fine particle series will become a dominant factor in the distribution of the carrier fine particles, so that the magnetization per particle becomes too low, which may cause carrier scattering, while, on the other hand, if it exceeds 150 $\mu$m, the specific surface area will be reduced, which may cause toner scattering and deteriorate the production quality of the contact printing part for full-color printing.

There is no particular restriction for the resin layer material and it can be selected suitably from publicly known materials, for example, silicone resins such as silicone resin, acrylic denatured silicone series resin, and fluorine denatured silicone resin, from the standpoint of durability and longevity. These materials can be used alone or as a mixture of more than two kinds of materials.

The resin layer can be formed by first dissolving the silicone resins into a solvent to prepare a coating solution, then uniformly coating the surface of the core material with the coating solution by means of the immersion method, the spray method, the brush painting method, etc., and baking it after drying.

There is no particular restriction for the solvent and it can be selected suitably from toluene, xylene, methyl ethyl ketone, methyl isobutyl ketone, and celsor butyl acetate, etc.

The baking process can be an externally heating method or an internally heating method, and can be selected from, for example, a method using either a fixed type electric furnace, a fluid type electric furnace, a rotary type electric furnace, and a burner furnace, or a method of using microwave, etc.

The ratio of the resin layer (resin coating amount) in the carrier should preferably be 0.01–5.0% by mass of the entire amount of the carrier.

If the ratio is less than 0.01% by mass, it is difficult to form a uniform resin layer, while, if the ratio exceeds 5.0% by mass, the resin layer becomes too thick and particle formation between carriers occurs, whereby a uniform carrier fine particles may not be obtained.

When the developing agent for electrophotography is one of the two component developing agents, the contents of the carrier in the two component developing agent is not particularly limited and can be selected suitably on a specific purpose, but it should preferably 90–98% by mass, or more preferably 93–97% by mass.

The developing agent for electrophotography of the present invention contains the toner for electrophotography of the present invention, so that it can provide a good balance between the electrostatic property and the fixing property during the image forming process, thus making it possible to form images of high quality in a stable manner.

While the toner for electrophotography of the present invention can be suitably applied to the image forming process of various publicly known electrophotography methods such as the magnetic one component developing method, non-magnetic one component developing method, and the two component developing method, it is more suitably applied to the image forming method and the image forming device of the present invention.

(Image Forming Method and Image Forming Device)

The image forming method of the present invention includes at least an electrostatic latent image forming process, a developing process and a transfer process, while it is more preferable to include a fixing process additionally, and it may include other processes as needed, for example, a charge-eliminating process, a cleaning process, a recycling process, a control process, etc.

The image forming device of the present invention comprised of at least an electrostatic latent image carrier, an electrostatic latent image forming means, a developing means, and a transfer means, while it is preferable to further include a fixing means, and it may include other means selected suitably as needed, for example, a charge-eliminating means, a cleaning means, a recycling means, a control means, etc.

The image forming method of the present invention can be suitably put into effect by means of the image forming device of the present invention, the electrostatic latent image forming process can be performed by means of the electrostatic latent image forming means, the developing process can be performed by the developing means, the transferring process can be performed by the transferring means, the fixing process can be performed by the fixing means, and the other processes can be performed by the other means.

Process and Means for Forming Electrostatic Latent Images

The electrostatic latent image forming process is a process of forming electrostatic latent images on an electrostatic latent image carrier.

There is no specific restriction on the electrostatic latent image carrier (sometimes referred to as "photoconductive insulator" or "photoconductor") as to its material, shape, structure, size, etc., except that a drum shape is preferred as its shape, and it can be selected from publicly known substances including inorganic photoconductors such as amorphous silicon and selenium, and organic photoconductors such as polysilane and phthalocyanine.

The formation of the electrostatic latent image can be performed by means of electrostatic latent image forming, for example, after uniformly charging the surface of the electrostatic latent image carrier, exposing a light imagewise.

The electrostatic latent image forming means is equipped with at least a charging device for uniformly charging the surface of the electrostatic latent image carrier and an exposing device for exposing the surface of the electrostatic latent image carrier imagewisly.

The charging process can be performed by applying a voltage to the surface of the electrostatic latent image carrier using the charging device.

There is no particular restriction for the charging device and it can be selected suitably in accordance with a specific purpose from, for example, a publicly known contact charger equipped with a conductive or semi-conductive roll, a brush, a film, a rubber blade, etc., a non-contacting charger using corona discharge such as corotron and scorotron.

The exposing process can be performed by exposing imagewisely the surface of the electrostatic latent image carrier using the exposing device.

There is no particular restriction for the exposing device so long as it provides imagewise exposure on the surface of the electrostatic latent image carrier using the exposing device and it can be selected suitably in accordance with a specific purpose from various exposing devices, for example, a copying optical system, a rod lens array system, a laser light system, a liquid crystal shutter optical system, etc.

It is also possible to use a backlighting system in the present invention, wherein the back of the electrostatic latent image carrier is exposed imagewisly.

Developing Process and Developing Means

The developing process is a process of developing the electrostatic latent images into visible images using a developing agent for electrophotography.

The formation of the visible images can be performed, for example, by developing the electrostatic latent images into visible images using a developing agent for electrophotography with the developing means.

The developing means includes at least a developing device that contains a developing agent for electrophotography and applies the developing agent for electrophotography to the electrostatic latent images in a contacting or non-contacting manner.

The developing device can be either of a dry developing type or a wet developing type, and either a monochromatic developing device or a multicolor developing device. It can be preferably one that has an agitator for charging the developing agent for electrophotography by friction and agitation, and a rotating magnet roller.

The developing device, for example, mixes and agitates the toner for electrophotography and the carrier, causes the toner for electrophotography to be charged due to the friction during the process, and maintains it in a standing condition on the surface of the rotating magnet roller, thus forming a magnetic brush. Since the magnetic roller is located in the vicinity of the electrostatic latent image carrier (photoconductor), a part of the toner for electrophotography that constitutes the magnetic brush formed on the surface of the magnetic roller moves to the surface of the electrostatic latent image carrier (photoconductor) due to a strong electric attraction force. Thus, the electrostatic latent image carrier is developed by the toner for electrophotography on the surface of the electrostatic latent image carrier (photoconductor).

The developing agent contained in the developing device is the developing agent for electrophotography, and the developing agent for electrophotography can be a one component developing agent or a two component developing agent. The toner contained in the developing agent for electrophotography is the toner for electrophotography of the present invention, for which a black toner is normally used in the case of a monochromatic development process, while a color toner selected from a magenta toner, an yellow toner, and a cyan toner in addition to the black toner is used in the case of a multicolor development process. In the case of a full color development process, a black toner, a magenta toner, an yellow toner, and a cyan toner are used.

Transfer Process and Transfer Means

The transfer process is a process for transferring the visible images to a transfer material.

The transfer process can be performed by transferring the visible images by the transfer means using the toner for electrophotography and a transfer charging device of reverse polarity. The transfer means includes at least a transfer device for peeling to charge the visible images formed on the electrostatic latent image carrier (photoconductor) to the transfer material side.

The transfer device can be selected from a corona transfer device using corona discharge, a transfer belt, a transfer roller, a pressure transfer roller, an adhesion transfer device, etc.

There is no particular restriction for the transfer material and it can be selected suitably from publicly known recording media (recording paper).

Fixing Process and Fixing Means

The fixing process is a process of fixing the transferred images transferred to the transfer material using a fixing device.

The fixing process can be performed by thermal-pressure-fixing the transfer images transferred to the transfer material using a thermal fixing roller, but flash fixing is more preferable, which can be performed by the fixing means.

The flash fixing process can be performed by irradiating the transferred images transferred to the transfer material with light using a flash fixing device by the flash fixing means.

The flash fixing means includes at least a flash lamp that radiates infrared light beams.

There is no particular restriction for the flash lamp and it can be selected suitably in accordance with a specific purpose preferably from, for example, infrared lamps, xenon lamps, etc.

The flash energy in the flash fixing process should preferably be approximately 1–3 J/cm$^2$.

If the flash energy is less than 1 J/cm$^2$, proper fixing may not be achieved, while, if it exceeds 3 J/cm$^2$, toner void or paper burning may occur.

The charge-eliminating process is a process of eliminating electrical charges by applying exposure on the entire surface or an charge-eliminating bias voltage to the electrostatic latent image carrier, which can be performed preferably by a charge-eliminating means.

There is no particular restriction for the charge-eliminating process so long as it is capable of applying exposure or a charge-eliminating bias voltage, and it can be selected suitably from publicly known charge-eliminating devices.

The cleaning process is a process of eliminating the toner for electrophotography remaining on an electrostatic latent image carrier, and can be performed preferably by a cleaning means.

There is no particular restriction for the cleaning means so long as it can eliminate the toner for electrophotography remaining on the electrostatic latent image carrier and it can be selected suitably from publicly known cleaners, for example, a magnetic brush cleaner, an electrostatic brush cleaner, a magnetic roller cleaner, a blade cleaner, a brush cleaner, a web cleaner, etc.

The recycling process is a process of recycling the toner for electrophotography removed by the cleaning process and can be preferably performed by a recycling means.

There is no particular restriction for the recycling means and it can be selected suitably from publicly known transmitting means.

There is no particular restriction for the controlling device so long as it can control operations of various means mentioned in the above and it can be selected suitably in accordance with a specific purpose from, for example, a sequencer, a computer, etc.

In the image forming method of the present invention, electrostatic latent images are formed on the electrostatic latent image carrier in the electrostatic latent image forming process. The electrostatic latent images are then developed by the developing agent for electrophotography to form visible images in the developing process. The visible images are then transferred to a transfer material in the transfer process. Consequently, the transferred images are fixed on the transfer material in the fixing process. As a result, the images are fixed and formed on the transfer material at an extremely fast speed.

In the image forming method of the present invention, electrostatic latent images are also formed on the electrostatic latent image carrier by the electrostatic latent image forming means. The developing means forms a visible image by receiving the developing agent for electrophotography and developing the electrostatic latent images. The visible images are then transferred to a transfer material by the transfer means. The transferred images are then fixed on the transfer material by the fixing means. Thus, images are fixed and formed on the transfer material at an extremely fast speed.

Since the developing agent for electrophotography according to the present invention containing the toner for electrophotography according to the present invention is used as the developing agent for electrophotography in the image forming device and the image forming method described in the above, electrostatic property and fixing property are provided in a superior balance during formation of images, so that images of high quality can be formed in a stable manner.

Although various embodiments of the present invention will be described below, the present invention is not limited by these embodiments.

(Synthesis of Cyclic Compounds 1 Through 6)

Synthesis of Cyclic Compound 1

A cyclic compound 1 was obtained by condensation/polymerization of bisphenol A propylene oxide and terephthalic acid. The acid value and the hydroxyl value of the cyclic compound 1 were both zero, so that it was ascertained that the cyclic compound 1 has a structure essentially with no terminal group.

Synthesis of Cyclic Compounds 2 Through 6

Cyclic compounds 2 through 6 were obtained by condensation/polymerization of bisphenol A propylene oxide compounds prepared in low concentration solutions and terephthalate compounds. The acid values and the hydroxyl values of the cyclic compounds 2 through 6 were all zero, so that it was ascertained that the cyclic compounds 2 through 6 have structures essentially with no terminal group.

Identifying the Structures of Cyclic Compounds 1 Through 6

Gas chromatograph and a mass spectroscope were used for the cyclic compound 1, a mass spectroscope was used for the cyclic compound 2, a mass spectroscope and a GPC device were used for the cyclic compound 3, and a GPC device was used for the cyclic compounds 4 through 6 to identify their structures.

1) Gas Chromatograph (GC-MS) Measurement

The measurement was made under the following conditions:

Equipment: GC-MS (gas chromatograph mass spectroscope, Type 6890/5973, manufactured by Hewlett Packard Co., Ltd.)

Column: HP-1

Preparation of the cyclic compound: Measure 1 g of the cyclic compound precisely, allow it to dissolve in a methanol solution of THF (tetrahydrofuran), extract the solution by filtration, convert the filtrate to trimethly silyl (TMS) and replaced —OH radicals with —OSi $(CH_3)_3$ radicals, thus preparation for a cyclic compound was carried out.

2) Mass Spectrometry (MS)

The measurement was made under the following conditions:

Equipment: Mass spectroscope (SX 102A, manufactured by Japan Electron Optics Ltd.)

Mass spectrometry method: FD-MS analysis

Ionization method: Field desorption

Measuring range: m/z=100–3000

Acceleration voltage: 8 kV

Ion multi: 1.2 kV

Emitter current: 0→30 mA

3) GPC Measurement (Gel Permeation Chromatography Measurement)

The compound was dissolved into tetrahydrofuran (THF), the solution was filtered with a 0.2 $\mu$m membrane filter, and a measurement of the molecular weight distribution of the component dissolved into tetrahydrofuran by means of differential refraction using the GPC device under the following conditions.

G.P.C. device: HLC-8120 GPC (Tosoh)

Column: TSK gel Super HM-M (manufactured by Tosoh Corporation) (500–106); two units combined Filling agent: Mainly stylene divinyl benzene gel Guard column: TSK guard column Super H-H (manufactured by Tosoh Corporation)

Flow rate: 0.6 ml/min

Specimen concentration: 0.1 wt % tetrahydrofuran

Detector: Differential refraction

Working curve: Cubic polynomial calibration curve using standard polystyrene (370–289000)

Solvent: Tetrahydrofuran (THF)

It was ascertained by the gas chromatography (GC-MS) measurement of the cyclic compound 1 that the cyclic compound 1 is a dehydrate having a peak at a molecular weight of 474 and another peak at a molecular weight of 492 obtained from the condensation/polymerization of bisphenol A propylene oxide and terephthalic acid. It was also ascertained that it had a peak at a molecular weight of 474 as a result of the mass spectrometry measurement. Table 1 shows the results.

It was ascertained by the mass spectrometry measurement of the cyclic compound 2 that the cyclic compound 2 is a dehydrate having a peak at a molecular weight 948 and obtained from a molecular weight 966, wherein both bisphenol A propylene oxide and terephthalic acid exist as dimers. Table 1 shows the results.

It was ascertained by the mass spectrometry measurement of the cyclic compound 3 that the cyclic compound 3 is a dehydrate having a peak at a molecular weight 1896 and obtained from a molecular weight 1900, wherein both bisphenol A propylene oxide and terephthalic acid exist as tetramers. Table 1 shows the results.

The structure of each of the cyclic compounds 4 through 6 is ascertained by the GPC measurements. Table 1 shows the results.

TABLE 1

| | Cyclic compound No. | | | | | |
|---|---|---|---|---|---|---|
| | 1 | 2 | 3 | 4 | 5 | 6 |
| GC-MS molecular weight | 474 | — | — | — | — | — |
| Mass spectrometry (FD-MS) molecular weight | 474 | 948 | 1896 | — | — | — |
| GPC molecular weight | — | — | 1900 | 4700 | 8500 | 11000 |
| Acid value | 0 | 0 | 0 | 0 | 0 | 0 |
| Hydroxyl value | 0 | 0 | 0 | 0 | 0 | 0 |
| Structure (bisphenol A propylene oxide and terephthalic acid) | Monomer-cyclic | Dimer-cyclic | Tetramer-cyclic | Decamer-cyclic | Dodecamer-cyclic | Dodecatrimer-cyclic |
| Theoretical molecular weight | 474 | 948 | 1896 | 4740 | 9480 | 10902 |

(Preparation of Toner and Development Agent for Electrophotography)

Toners for electrophotography 1 through 13 shown in Table 2 were prepared using the cyclic compounds 1 through 6, using polyester resin as the binder resin, using N-01 made by the Orient Chemical as the positive charging control agent, using Carbon Black #25 (Mitsubishi Chemical) as the black pigment, and using polypropylene wax (NP 105, Mitsubishi Chemical) as the wax.

The materials shown in Table 2 were mixed in the mixing ratios shown in Table 2 in a Henschel mixer as the preliminary mixing, melt-kneaded to be solidified with each component distributed evenly in the binder resin, pulverized and classified to obtain positive charging black toner base with an average particle diameter (volumetric average particle size ($D_{50}$)) of 9 $\mu$m.

Next, 0.8 parts by mass of hydrophobic silica was externally added to each of these to produce toners for electrophotography. A polyester resin containing ethylene oxide of bisphenol A as the principal diole content as well as terephthalic acid and trimellitic acid as the principal carboxylic acid content was used as the binder resin.

The toners for electrophotography 1 through 13 thus obtained were each prepared and mixed with ferrite carrier (average particle diameter of 60 $\mu$m) in such a way that the toner concentration becomes 4.5% by mass to produce developing agents for electrophotography 1 through 13.

EMBODIMENTS 1 THROUGH 12 AND A COMPARATIVE EXAMPLE 1

Each of the developing agents for electrophotography 1 through 13 were loaded on a modified FK 6718K printer (Fujitsu Ltd.), and were irradiated with xenon flash light having a high intensity in the wavelength range of 700–1500 nm to be photo-fixed. Images were formed by fixing visible images on normal paper (product name: "NIP-1500LT, Kobayashi Recording Paper) used as the transfer material.

<Evaluation>

The following tape peeling test was conducted on each sheet of normal paper affixed with the toners 1 through 13 for electrophotography to evaluate the fixing rate of each toner for electrophotography according to the following evaluation standard. Table 2 shows the results.

Fixing Rate Test (Tape Peeling Test)

The image printing density on normal paper on which the toner for electrophotography was fixed was measured as the optical density. Next, a peeling tape (product name: "Scotch Mending Tape" by Sumitomo 3M) was adhered onto the visible image on normal paper formed by the toners for electrophotography, and then the peeling tape was peeled off to measure the optical density on normal paper after peeling. Based on these measurements, each image printing density on the normal paper after peeling was expressed in a percentage in a case where the image printing density on normal paper before peeling was 100 and was evaluated as the fixing rate of the particular toner for electrophotography according to the following standards.

⊙ when the printing density variation is 5% or less.

○ when the printing density variation is more than 5% and 10% or less.

X when the printing density variation is more than 10%.

Macbeth PCM meter was used for measuring the optical density.

Evaluation of Electrostatic Property

The modified FK 6718K printer (Fujitsu Ltd.) was run in an environmental test room under a normal environment (temperature: 25° C., humidity: 50%) for 50 ks and a high temperature/high humidity environment (temperature: 32° C., humidity: 80%) for 50 ks respectively and totaled 100 ks, and charging variations under the normal and high temperature/high humidity environment were measured to be evaluated according to the following evaluation standards.

Evaluation Standards

⊙ when more than 80% of the electrostatic property under the high temperature/high humidity environment during the last 50 ks is maintained against the electrostatic property under the normal environment during the initial 50 ks.

○ when 60% or more and less than 80% of the electrostatic property under the high temperature/high humidity environment during the last 50 ks is maintained against the electrostatic property under the normal environment during the initial 50 ks.

X when less than 60% of the electrostatic property under the high temperature/high humidity environment during the last 50 ks is maintained against the electrostatic property under the normal environment during the initial 50 ks.

TABLE 2

| | | Embodiment/Comparative Example | | | | | | | | | | | | |
|---|---|---|---|---|---|---|---|---|---|---|---|---|---|---|
| | | E1 | E2 | E3 | E4 | E5 | E6 | E7 | E8 | E9 | E10 | E11 | E12 | E13 |
| | | Toner No. | | | | | | | | | | | | |
| | | T1 | T2 | T3 | T4 | T5 | T6 | T8 | T9 | T10 | T11 | T12 | T13 | T7 |
| | | Cyclic compound No. | | | | | | | | | | | | |
| | | 1 | 2 | 3 | 4 | 5 | 6 | 3 | 3 | 3 | 3 | 3 | 3 | — |
| Toner mix ratio (mass) | Binder resin | 85 | 85 | 85 | 85 | 85 | 85 | 87 | 86.5 | 77 | 67 | 57 | 52 | 87 |
| | Cyclic compound | 2 | 2 | 2 | 2 | 2 | 2 | 0.01 | 0.5 | 10 | 20 | 30 | 35 | 0 |
| | #25 carbon black | 10 | 10 | 10 | 10 | 10 | 10 | 10 | 10 | 10 | 10 | 10 | 10 | 10 |
| | N-01 (charging control agent) | 2 | 2 | 2 | 2 | 2 | 2 | 2 | 2 | 2 | 2 | 2 | 2 | 2 |
| | NP105 (polypropylene) numerical average molecular weight = 10000 | 1 | 1 | 1 | 1 | 1 | 1 | 1 | 1 | 1 | 1 | 1 | 1 | 1 |

TABLE 2-continued

| | | Embodiment/Comparative Example | | | | | | | | | | | | |
|---|---|---|---|---|---|---|---|---|---|---|---|---|---|---|
| | | E1 | E2 | E3 | E4 | E5 | E6 | E7 | E8 | E9 | E10 | E11 | E12 | E13 |
| | | Toner No. | | | | | | | | | | | | |
| | | T1 | T2 | T3 | T4 | T5 | T6 | T8 | T9 | T10 | T11 | T12 | T13 | T7 |
| | | Developing agent No. | | | | | | | | | | | | |
| | | 1 | 2 | 3 | 4 | 5 | 6 | 8 | 9 | 10 | 11 | 12 | 13 | 7 |
| Evaluation | Fixing property | ◎ | ◎ | ◎ | ○ | ○ | Δ | ○ | ○ | ◎ | ○ | Δ | Δ | Δ |
| | Initial charging amount (μC/g) | 20 | 21 | 19 | 20 | 22 | 21 | 21 | 20 | 21 | 22 | 24 | 25 | 20 |
| | Normal environmental average charging amount (μC/g) | 22 | 23 | 20 | 22 | 22 | 22 | 22 | 22 | 22 | 23 | 25 | 27 | 22 |
| | High temp/high humidity average charging amount (μC/g) | 18 | 19 | 18 | 18 | 19 | 18 | 16 | 17 | 20 | 20 | 21 | 23 | 15 |
| | Charge variation judgement | ◎ | ◎ | ◎ | ◎ | ◎ | ◎ | ○ | ○ | ◎ | ◎ | ◎ | ◎ | ○ |

E1: Embodiment 1
C1: Comparative Example 1
T1: Toner

From the results shown in Table 2, it can be seen that the embodiments using the toners for electrophotography 1 through 6 and 8 through 13 containing the cyclic compounds 1 through 6 provided excellent electrostatic property and little charge amount fluctuations due to environmental changes, proving that excellent results were obtained with well-balanced electrostatic property and fixing property. On the contrary, the Comparative Example in which the toner 7 for electrophotography that does not contain any cyclic compound provided results inferior to the embodiments in terms of fixing property and electrostatic property variation, proving that it lacked balance of electrostatic property and fixing property.

The present invention can provide a toner for electrophotography capable of providing well-balanced electrostatic property and fixing property during the image forming process hence forming images of high quality in a stable manner, as well as a developing agent for electrophonic photography, an image forming method, and an image forming device using the toner for electrophotography.

What is claimed is:

1. A toner for electrophotography comprising a cyclic compound selected from the group consisting of cyclic oligomers having essentially no terminal groups and cyclic polymers having essentially no terminal groups, the cyclic compound being an ester compound and wherein the ester compound is a product produced by condensation/polymerization of dicarboxylic compounds and diol compounds.

2. The toner for electrophotography according to claim 1, wherein the condensation/polymerization product is produced by condensation/polymerization of the same number of the dicarboxylic compounds and the diol compounds.

3. The toner for electrophotography according to claim 1, wherein a molecular weight of the cyclic compound is 10,000 or less.

4. The toner for electrophotography according to claim 1, wherein a molecular weight of the cyclic compound is 2,000 or less.

5. The toner for electrophotography according to claim 1, wherein a content of the cyclic compound is less than 30% by mass.

6. The toner for electrophotography according to claim 1, wherein a content of the cyclic compound is 0.01–20% by mass.

7. The toner for electrophotography according to claim 1, wherein a content of the cyclic compound is 1–15% by mass.

8. The toner for electrophotography according to claim 1, further comprising at least one member selected from the group consisting of binder resins, coloring agents, and charging control agents.

9. The toner for electrophotography according to claim 1, further comprising an infrared light absorbing agent.

10. The toner for electrophotography according o claim 1, wherein the toner for electrophotography is a flash fixing toner.

11. A toner for electrophotography comprising a cyclic compound selected from the group consisting of cyclic oligomers having essentially no terminal groups and cyclic polymers having essentially no terminal groups, the cyclic compound being an ester compound and wherein the ester compound is a product produced by condensation/polymerization of dicarboxylic compounds, diol compounds, and hydroxylcarboxylic compounds.

12. The toner for electrophotography according to claim 11, wherein an acid value and a hydroxyl value of the condensation/polymerization product is zero.

13. A developing agent for electrophotography comprising a toner and a carrier for electrophotography wherein the toner for electrophotography comprises a cyclic compound selected from the group consisting of cyclic oligomers having essentially no terminal groups and cyclic polymers having essentially no terminal groups;

wherein the cyclic compound is an ester compound and wherein the ester compound is a product produced by:

condensation/polymerization of dicarboxylic compounds and diol compounds, or condensation/polymerization of dicarboxylic compounds and diol compounds, and hydroxylcarboxylic compounds.

14. The developing agent according to claim 13, wherein the carrier has a surface covered with a coating material containing silicone resin.

15. An image forming method comprising:

a step for forming an electrostatic latent image on an electrostatic laten image carrier;

a step for developing the electrostatic latent image using a toner for electrophotography so as to form visible images; and a step for transferring the visible images to a transfer material;

wherein the toner for electrophotography comprises a cyclic compound selected from the group consisting of cyclic oligomers having essentially no terminal groups and cyclic polymers having essentially no terminal groups;

wherein the cyclic compound is an ester compound and wherein the ester compound is a product produced by:

condensation/polymerization of dicarboxylic compounds and diol compounds, or condensation/polymerization of dicarboxylic compounds and diol compounds, and hydroxylcarboxylic compounds.

16. An image forming device comprising:

an electrostatic latent image carrier;

means for forming electrostatic latent images on the electrostatic latent image carrier;

means for developing the electrostatic latent image using a toner for electrophotography so as to form visible images, wherein the means for developing the electrostatic latent image comprises a toner for electrophotography comprising a cyclic compound selected from the group consisting of cyclic oligomers having essentially no terminal groups and cyclic polymers having essentially no terminal groups, the cyclic compound being an ester compound and wherein the ester compound is a product produced by condensation/polymerization of dicarboxylic compounds, diol compounds, and hydroxylcarboxylic compounds; and means for transferring the visible images to a transfer material.

17. The image forming device according to claim 16, further comprising a flash fixing means for flash fixing the transferred images transferred to the transfer material.

* * * * *